United States Patent [19]

Misawa

[11] Patent Number: 4,522,487

[45] Date of Patent: Jun. 11, 1985

[54] SEALING DEVICE FOR ELECTROSTATIC COPYING MACHINE

[75] Inventor: Norio Misawa, Yokohama, Japan

[73] Assignee: Tokyo Shibaura Denki Kabushiki Kaisha, Kawasaki, Japan

[21] Appl. No.: 393,535

[22] Filed: Jun. 30, 1982

Related U.S. Application Data

[62] Division of Ser. No. 154,382, May 29, 1980, abandoned.

[30] Foreign Application Priority Data

Jun. 8, 1979 [JP] Japan ..... 54-78040

[51] Int. Cl.[3] ..... G03G 21/00

[52] U.S. Cl. ..... 355/15

[58] Field of Search ..... 355/3 R, 15; 15/1.5, 15/256.51, 256.52

[56] References Cited

U.S. PATENT DOCUMENTS

| | | | |
|---|---|---|---|
| 3,634,077 | 1/1972 | Sullivan | 355/15 X |
| 3,740,789 | 6/1973 | Ticknor | 355/15 X |
| 3,784,297 | 1/1974 | Ito | 355/3 R |
| 3,950,092 | 4/1976 | Zoltner | 355/15 |
| 4,030,824 | 6/1977 | Smith | 355/15 |

*Primary Examiner*—Fred L. Braun

*Attorney, Agent, or Firm*—Banner, Birch, McKie & Beckett

[57] ABSTRACT

A sealing roller for preventing toner particles from inadvertently soiling the inside of an electrostatic copying machine. The sealing roller is placed in rolling contact with the photoconductive surface and seals the gap between that surface and the residual particle cleaning device housing. Any particles that are not removed by the cleaning device are therefore prevented from escaping and soiling the machine.

1 Claim, 8 Drawing Figures

FIG. 3
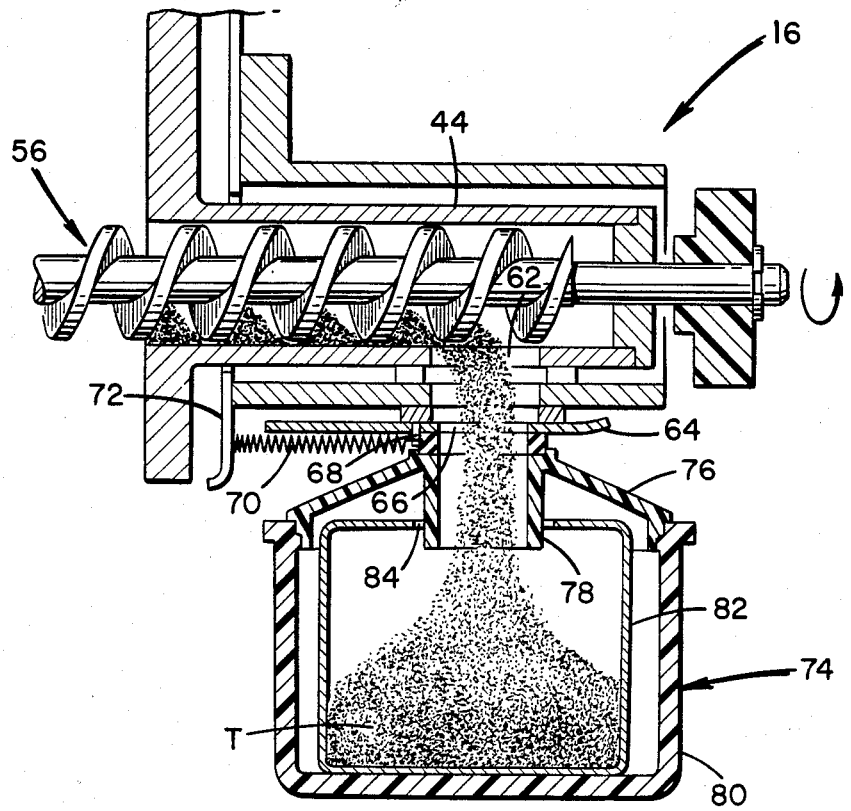
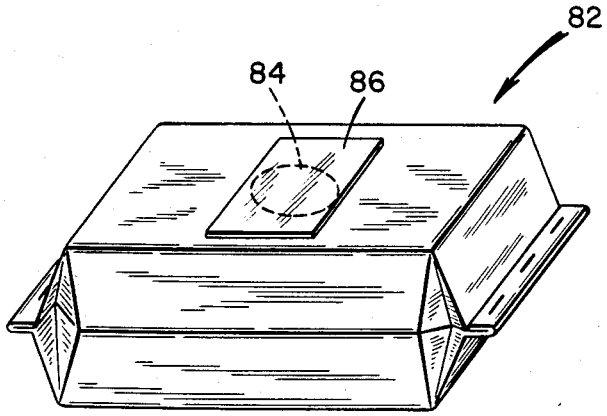
FIG. 5

FIG. 4A
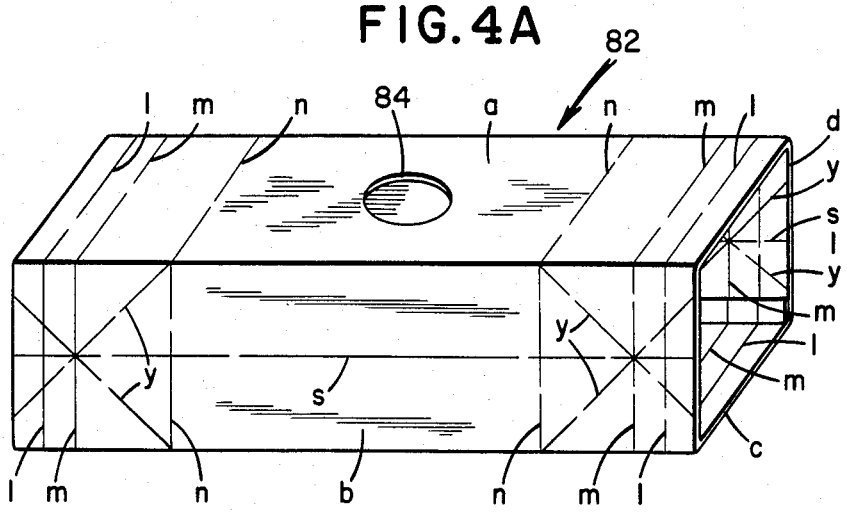
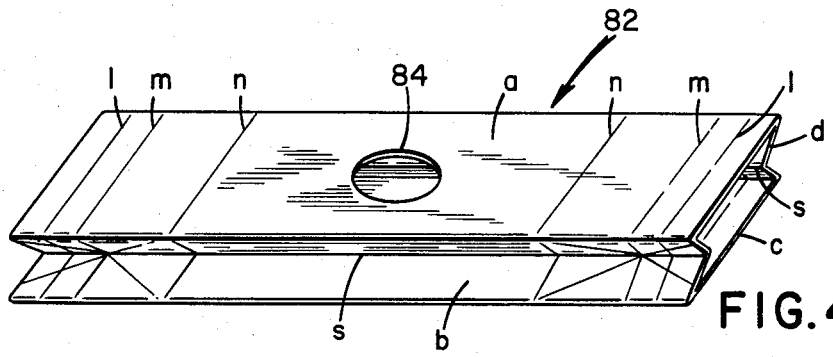
FIG. 4B
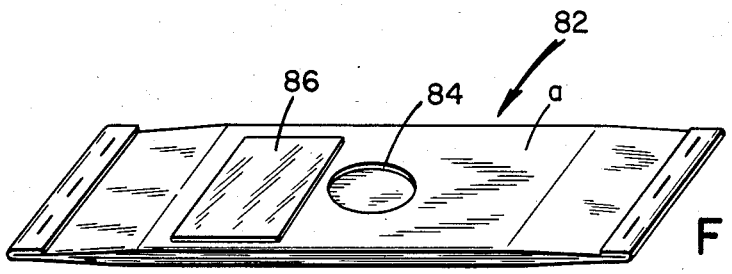
FIG. 4C
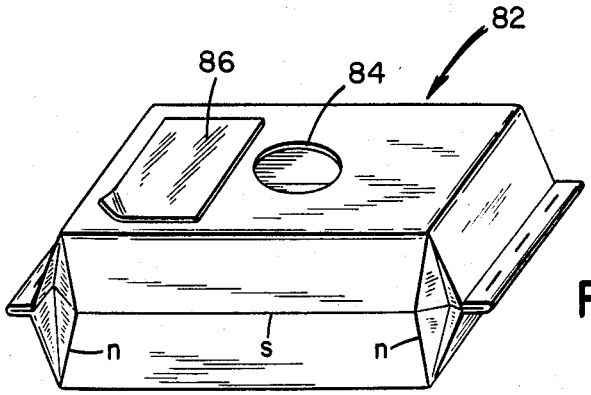
FIG. 4D

SEALING DEVICE FOR ELECTROSTATIC COPYING MACHINE

This is a division of application Ser. No. 154,382, filed May 29, 1980, now abandoned.

BACKGROUND OF THE INVENTION

This invention relates to a cleaning device for an electrostatic copying machine and particularly to a sealing roller for preventing toner particles from escaping from the residual toner cleaning device housing.

In general, in electrostatic copying machines, a photoconductive member is charged. The photoconductive member then is exposed to a light image corresponding to the original subject matter to form a latent electrostatic image on the surface of the photoconductive member. In accordance with the electric potential of the latent electrostatic image, a developing apparatus causes an electrically charged toner to adhere to the latent electrostatic image on the photoconductive member to form a developed image. The developed image is then transferred to and fixed on paper. Residual toner particles on the photconductive member then are removed by a cleaning device. In this manner, copies are made by a typical electrostatic copying machine.

The cleaning device comprises a housing, a removing device within the housing which removes the residual toner particles from the photconductive member and a collecting device which collects the residual toner particles. The removing device uses a cleaning roller such as shown in U.S. Pat. No. 3,784,297 (Ito et al) or blades such as shown in U.S. Pat. No. 4,030,824. Blades are extensively used in electrostatic copying machines because of their simple construction and the small space required for setting them up in copying machines. In cleaning devices of the prior art, residual toner particles can escape from the cleaning device housing and soil the inside of the copying machine.

As to the collecting device, plastic collecting boxes, formed of a relatively hard material have been used in the past. These plastic collecting boxes take up a great amount of space when packed for commercial distribution or shipment. Also, the residual toner particles must be transferred from the plastic collecting box to a vinyl sack or the like for burning because, if these particles are burned together with the plastic collecting box, harmful gases would be generated by the burning plastic and damage would occur to the incinerating furnace. However, the step of transferring the residual toner particles from the collecting box to a vinyl sack wastes time, dirties the hands of the operator and dirties the collecting device itself. Finally, since plastic collecting boxes are not deformable, they take considerable packaging space and are inconvenient to carry.

SUMMARY OF THE INVENTION

It is an object of the present invention to provide an improved cleaning device for an electrostatic copying machine which obviates the above disadvantages by utilizing a sealing roller.

It is a further object of the present invention to provide a sealing roller for preventing the residual toner particles from escaping from the cleaning device housing and soiling the inside of the copying machine.

It is a further object of the present invention to provide a rotatably sealing roller in rolling contact with, but does not damage, the photoconductive surface.

The present invention is directed to a sealing roller rotatably provided on the front end of a base plate in rolling contact with the photoconductive surface. The gap between the photoconductive surface and the cleaning device housing is sealed by the sealing roller. Any residual toner particles that are not removed by the cleaning device are therefore prevented from escaping from the cleaning device housing.

BRIEF DESCRIPTION OF THE DRAWINGS

FIG. 3 is a sectional view showing residual toner particles in the collecting bag.

FIGS. 4A–4D are perspective views showing the manner of constructing the collecting bag.

FIG. 5 is a perspective view showing the collecting bag with its opening sealed.

DETAILED DESCRIPTION OF THE PREFERRD EMBODIMENT

Figure 1:
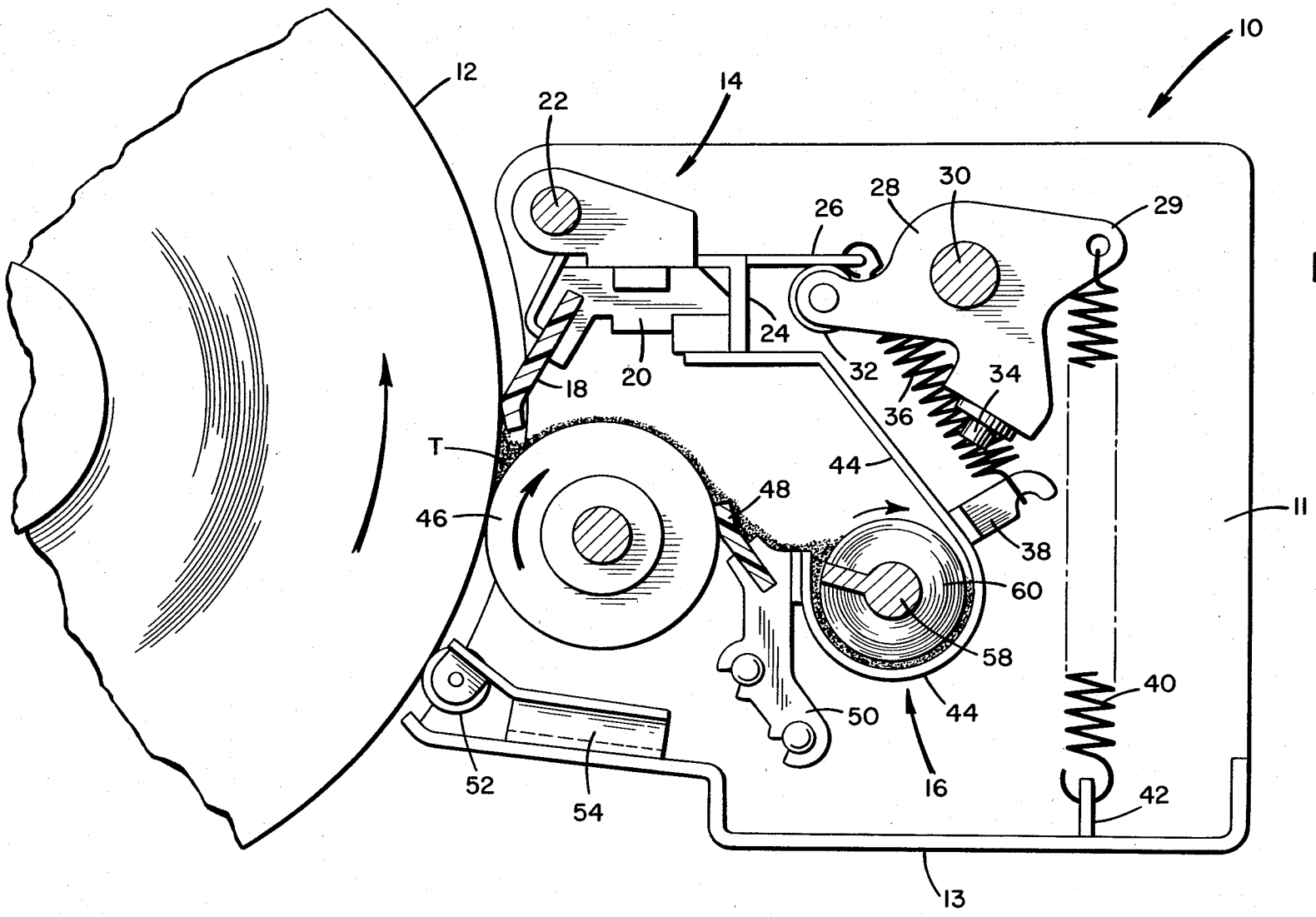
FIG. 1 is a side view of the cleaning device for an electrostatic copying machine according to the present invention.

Referring now to FIGS. 1–5, an explanation will be given regarding a preferred embodiment of the invention. As shown in FIG. 1, a cleaning device 10 faces a portion of the surface of a photoconductive drum 12. In addition to the cleaning device 10, other devices of the electrostatic copying machine, such as a charging device, exposing device, developing device and a transfer device, face the surface of photoconductive drum 12 as is well known in the art.

The cleaning device 10 comprises a removing device 14 and a collecting device 16. The removing device 14 includes a main blade 18 which extends parallel to an axis of the photoconductive drum 12. The main blade 18 consists of a hard elastic material such as butyl rubber. One end of the main blade 18 is pressed against the photoconductive drum 12 for removing residual toner particles T from the drum 12 and the other end is held in a holder 20. The front end of the holder 20 is pivotably connected to a shaft 22 which is supported by a pair of frames 11. The rear end of the holder 20 has a downwardly extending brim 24 and a horizontally extending bracket 26. A link 28 is rotatably connected to shaft 30 which is supported by frames 11 and a front end of the link 28 has a roller 32. The shaft 30 is connected to a driving mechanism (not shown) and is held in the position shown in FIG. 1 by the driving mechanism. A spring 40 is provided between a rear end 29 of the link 28 and a hook 42. The spring 40 forces the link 28 to turn in the clockwise direction. When the shaft 30 is released by the driving mechanism, the link 28 is turned clockwise by the spring 40 until limited by stopper 34 which contacts the back surface of container 44.

Upon turning the link 28 in the clockwise direction, the support roller 32 moves upwardly and the holder 20 is turned counterclockwise to remove the main blade 18 from the photoconductive drum 12. The roller 32 supports the bracket 26 which is downwardly biased by spring 36. The spring 36 is provided between the bracket 26 and a hook 38 which is connected to a back surface of container 44 for turning the bracket 26 clockwise to press the main blade 18 against the photoconductive drum 12.

A collecting roller 46 is provided below the main blade 18 for collecting and transporting the residual toner particles T removed from the photoconductive drum 12. The collecting roller 46, which consists of a rubber roller, is rotatably supported in rolling contact with the photoconductive drum 12. Another blade 48 is pressed against the collecting roller 46 for removing residual toner particles T from the collecting roller 46 and transferring these particles to the collecting device 16. One end of blade 48 is supported by support member 50. A sealing roller 52 is provided below the collecting roller 46 for preventing the residual toner particles T from dropping out of the cleaning device 10. The sealing roller 52 is rotatably supported by support member 54, which is secured to the front end of base plate 13, in rolling contact with the photoconductive drum 12.

Figure 2:
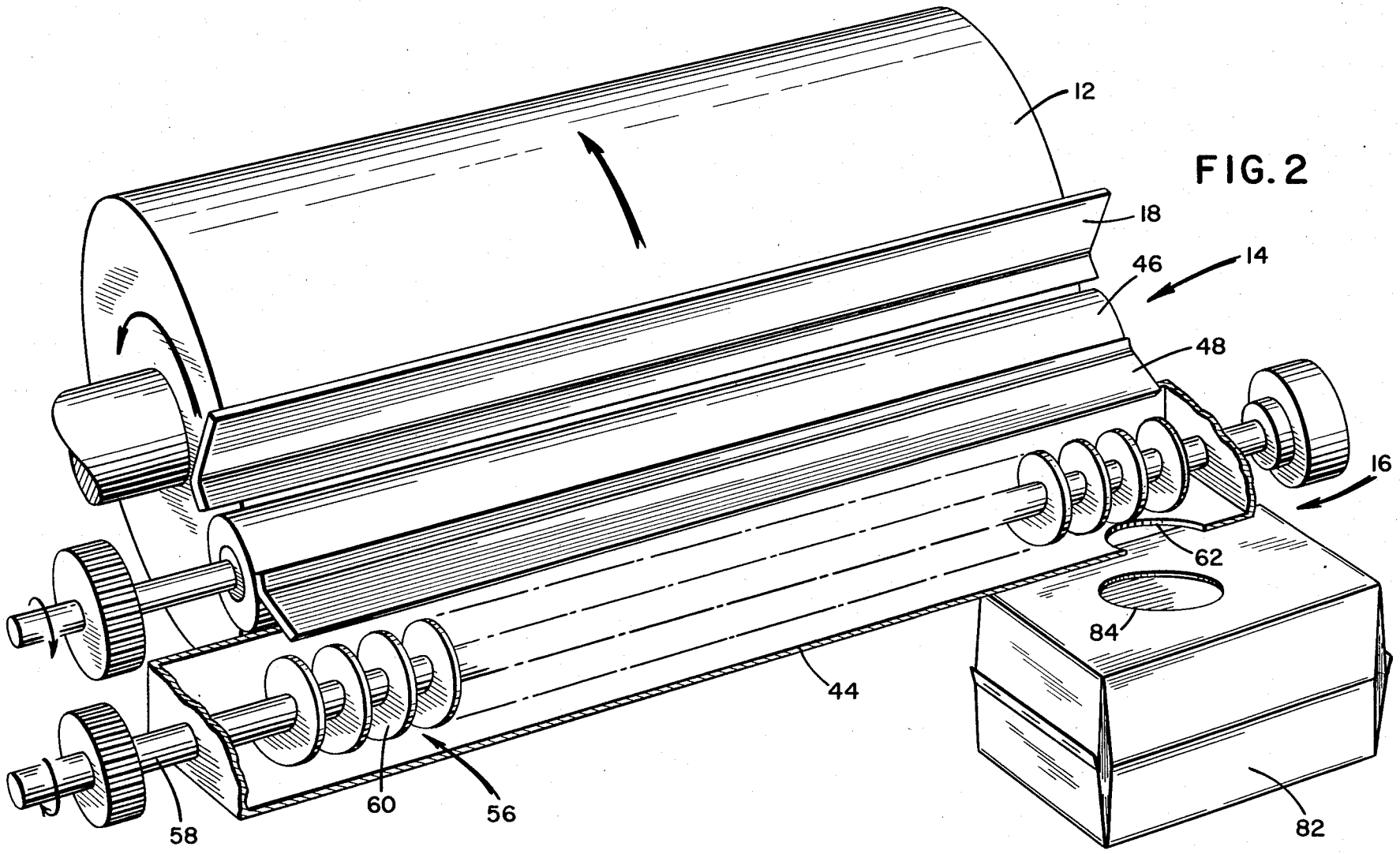
FIG. 2 is a perspective view of the cleaning device including a collecting bag.

FIGS. 2 and 3 show the collecting device 16 in further detail. The collecting device 16 comprises the container 44, a screw roller 56 and a collecting bag 82. The container 44 extends along the lower edge of the blade 48 for receiving the residual toner particles T removed from the photoconductive drum 12. The residual toner particles T are first scraped from the photoconductive drum 12 by the main blade 18 and then transferred by roller 46 to the blade 48 which scrapes the particles from the collecting roller 46. An opening 62 is formed at the end and bottom of the container 44 for passing the toner particles T. The screw roller 56 is rotatably provided within the container 44. The screw roller 56 has a helical blade 60 formed on shaft 58 for transporting the residual toner particles T to the opening 62. As shown in FIG. 3, a sliding shutter 64 having an opening 66 and a pin 68 is provided below the opening 62 for closing the opening 62 when a collecting bag 82 is not located under the opening 62. A spring 70 is provided between the pin 68 and plate 72 to bias the shutter 64 in the right direction to close the opening 62. An outer box 74 is positioned below the opening 62 of the container 44 for supporting the collecting bag 82. The outer box 74 may be formed by a relatively hard material such as a plastic material and comprises a box 80 and a cover 76. The cover 76 has a downwardly extending guide pipe 78 which is coupled to an opening 84 in the collecting bag 82.

FIG. 4 shows the detailed construction of the collecting bag 82. As shown in FIG. 4A, in the first step of forming the collecting bag 82, a comparatively thick, foldable and inflamable paper is formed into a tubular shape having a rectangular sectional profile. One of the sides of this rectangular tube, namely side a, has an opening 84. The individual sides a, b, c and d are provided with many folding lines. More particularly, opposite end portions of the sides a, b, c and d are provided with folding lines l, m and n extending at right angles to the longitudinal direction and spaced apart a predetermined distance from one another. The sides b and d are each provided with longitudinal central folding lines s. The opposite ends of these sides b and d are also provided with folding lines y which intersect the folding lines l, m and n. As shown in FIG. 4B, the sides b and d are folded inwards along the folding lines s. As shown in FIG. 4C, the opposite end portions adjacent the folding lines l are folded back and secured by suitable securing means such as staples. As a result, the collecting bag 82 is formed in a flat configuration with the sides a and c in close proximity to each other. A readily detachable seal 86 is attached to side a for sealing the opening 84. These collecting bags 82 may be stacked in the folded state to minimize the amount of space required for storage and transportation. As shown in FIG. 4D, in use, the folded portions of the collecting bag 82 along the folding lines s are unfolded while folded portions along the folding lines n, m and y are bent to obtain a three-dimensional collecting bag 82.

As shown in FIG. 3, when this collecting bag 82 is loaded into the box 80, the guide pipe 78 is connected to the opening 84 of the bag 82 and the cover 76 covers the box 80. As a result, although the collecting bag 82 is made of paper, it can be sufficiently protected and supported by the box 80 which provides mechanical strength. The shutter 64 must be slid to place the opening 66 of the shutter 64 under the opening 62 of the container 44. The residual toner particles T then are removed by the removing device 14 and transported to the opening 62 by the screw roller 56. As a result, the residual toner particles T will be fed to the collecting bag 82 through the openings 62 and 66 and guide pipe 78.

When the collecting bag 82 is filled with residual toner particles T, the collecting bag 82 is taken out of the box 80 and the opening 84 is sealed with the seal 86 as shown in FIG. 5. The collecting bag 82, with the residual toner particles T sealed inside, can be burnt or disposed of cleanly without dropping toner particles on the machine of hands. In case of burning, since the collecting bag 82 is made of paper, no harmful gases are generated.

While in the above embodiment, the collecting bag 82 is formed by a comparatively thick paper sheet, any material which is foldable and inflammable can be used to form the collecting bag. Various other modifications of the collecting bag of the present invention would also be apparent to one of ordinary skill in the art.

I claim:

1. In a cleaning device for removing residual toner particles from a photoconductive surface of an electrostatic copying machine, said cleaning device including a base plate, a toner particle removing device adjacent the base plate to remove residual particles from the photoconductive surface, a collecting roller rotatably supported in rolling contact with the photoconductive surface adjacent said toner particle removing device to transport toner particles removed from the photoconductive surface, and an enclosure, the improvement comprising:

a sealing roller separate from said collecting roller rotatably provided on the front end of the base plate in rolling contact with the photoconductive surface to prevent the residual toner particles from escaping from said enclosure.

* * * * *